United States Patent [19]

Staehli

[11] Patent Number: 4,507,827

[45] Date of Patent: Apr. 2, 1985

[54] CLEANING MACHINE FOR FIBER MATERIAL

[75] Inventor: Urs Staehli, Turbenthal, Switzerland

[73] Assignee: Rieter Machine Works Ltd., Winterthur, Switzerland

[21] Appl. No.: 544,860

[22] Filed: Oct. 24, 1983

[30] Foreign Application Priority Data

Nov. 5, 1982 [CH] Switzerland ..... 6445/82

[51] Int. Cl.[3] ..... D01B 3/00

[52] U.S. Cl. ..... 19/200; 19/203; 19/306

[58] Field of Search ..... 19/200, 203, 204, 205, 19/105, 106 R, 94, 95, 97.5, 109, 304, 296, 306

[56] References Cited

U.S. PATENT DOCUMENTS

| | | | |
|---|---|---|---|
| 2,313,256 | 3/1943 | Morgan | 19/205 |
| 2,987,779 | 6/1961 | Kawashima | 19/106 R |
| 3,115,683 | 12/1963 | Reiterer | 19/105 |
| 3,470,588 | 10/1969 | Just | 19/95 X |
| 3,894,315 | 7/1975 | Fukuta et al. | 19/150 |
| 3,916,485 | 11/1975 | Doudlebsky et al. | 19/105 X |
| 3,982,302 | 9/1976 | Vaalburg | 264/518 |
| 4,152,812 | 5/1979 | Goodin | 19/203 |
| 4,224,720 | 9/1980 | Morgner et al. | 19/204 |

FOREIGN PATENT DOCUMENTS

| | | |
|---|---|---|
| 2743187 | 3/1978 | Fed. Rep. of Germany . |
| 2934562 | 3/1981 | Fed. Rep. of Germany . |
| 1556601 | 11/1979 | United Kingdom . |

*Primary Examiner*—Louis K. Rimrodt
*Assistant Examiner*—J. L. Kravitz
*Attorney, Agent, or Firm*—Werner W. Kleeman

[57] ABSTRACT

The cleaning machine for fiber material has an opening roller provided with clothing. The cleaned fibers are again removed from the clothing into a suction chamber by means of a screening member containing a screening wall provided with a nose. The invention improves the clean separation or detachment of the fiber material from the clothing in comparison with the known arrangements, avoids collection of fibers at the nose of the screening member, and, in particular, requires a smaller quantity of suction air in the suction duct leading away from the suction chamber. To achieve this the mutual spacing of the screening wall and roller envelope or outer surface increases in a direction away from the nose in the direction of rotation of the opening roller towards the rearward end of the screening wall.

8 Claims, 1 Drawing Figure

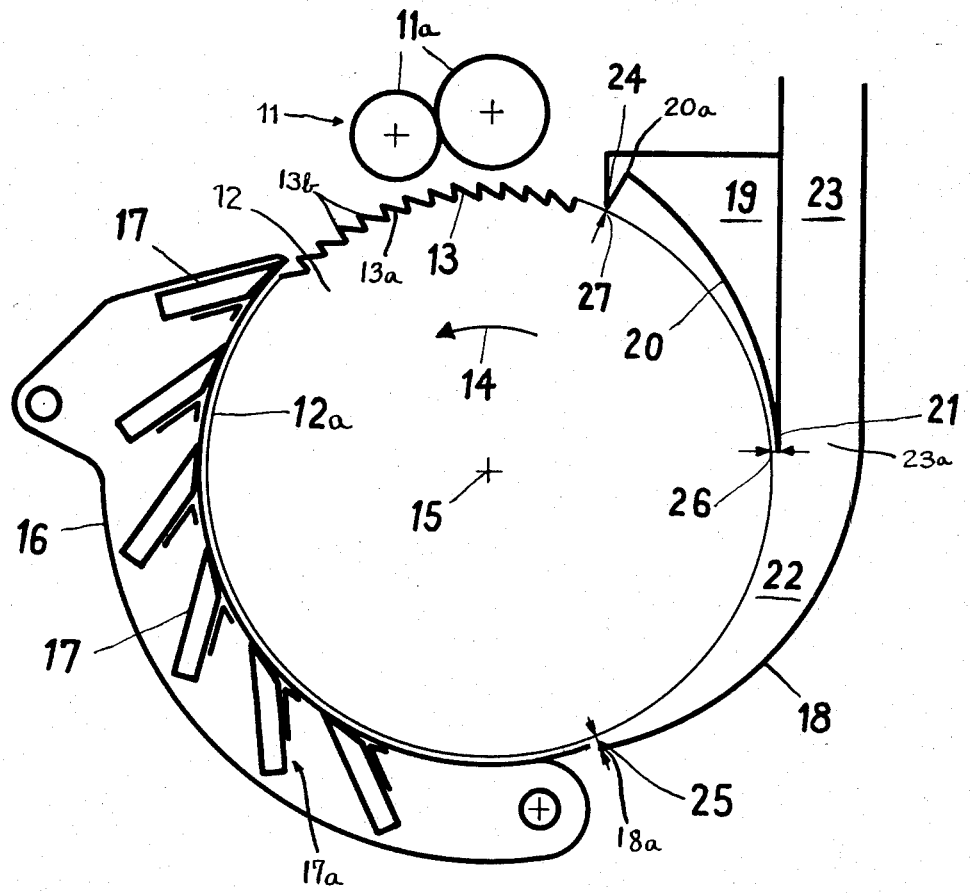
11a
11
24
20a
19
23
12
13b
17
13a
13
27
20
14
12a
21
23a
26
15
16
22
17
18
25
18a
17a

CLEANING MACHINE FOR FIBER MATERIAL

CROSS REFERENCE TO RELATED APPLICATION

This application is related to my commonly assigned, copending U.S. application Ser. No. 6,540,887, filed 10/11/83, entitled "Grating Arrangement For An Opening Roller For Fibers".

BACKGROUND OF THE INVENTION

The present invention relates to a new and improved cleaning machine for fiber material or the like.

In its more specific aspects the cleaning machine for fiber or fibrous material comprises an opening roller rotatable about an axis of rotation and provided with clothing. Arranged in the following order around the opening roller are a feed device for the fiber material, a grating composed of bars, a suction chamber and a screening member, these components or parts which are arranged around the opening roller extend over the length of the latter in the direction of the rotational axis of such opening roller. The screening member has a nose or nose member which forms part of an entry or inlet opening of a suction duct leading away from the suction chamber, and a screening wall of the screening member extends away from the nose in the rotational direction of the opening roller over a part of the roller envelope or outer surface containing or enclosing the points or tips of the clothing.

From German Published Patent Application No. 1,010,878 or from German Pat. No. 1,685,571, it is known, for example, to place fiber material in rapid rotation by means of an opening roller for the purpose of cleaning the material, whereby as a result of the centrifugal forces thus produced the impurities, for example, seeds and dust particles fly out of the fiber material. These outwardly propelled impurities are then led away through a grating or grating arrangement extending over a part of the envelope or outer surface of the opening roller.

A screening member with a screening sheet serves for the removal of the fiber material clinging to the clothing of the opening roller, this screening sheet extending over part of the envelope or outer surface of the opening roller at a small, constant spacing from the clothing. A nose is provided at the front end (considered with reference to the direction of rotation of the opening roller) of the divertor member or screening sheet. Fiber material freed from the clothing by the screening member passes into a suction duct through which it is transported away for further processing.

SUMMARY OF THE INVENTION

It is a primary object of the present invention to improve upon the existing limitations and shortcomings of the prior art cleaning machines for fiber material or the like.

It is another more specific object of the present invention to provide for an improved clean and effective separation of the fiber material from the clothing in relation to the known cleaning devices or machines and to avoid collecting of fibers on the nose or separating edge of the screening member, with the quantity of suction air required in the suction duct being smaller than in the known arrangements.

Now, in order to implement these and still further objects of the present invention, which will become more readily apparent as the description proceeds, the cleaning machine of the present development is manifested by the features that the mutual spacing of the screening wall and clothing increases in the direction of rotation of the roller from the nose or nose member towards the rearward or rear end of the screening wall.

BRIEF DESCRIPTION OF THE DRAWINGS

The invention will be better understood and objects other than those set forth above, will become apparent when consideration is given to the following detailed description thereof. Such description makes reference to the annexed drawing wherein the single FIGURE thereof shows a cross-section of a cleaning machine constructed according to the present invention.

DETAILED DESCRIPTION OF THE PREFERRED EMBODIMENTS

Describing now the single FIGURE of the drawing, it is to be understood that only enough of the details of the construction of the therein illustrated exemplary embodiment of cleaning machine have been shown as needed for those skilled in the art to readily understand the underlying principles and concepts thereof, while simplifying the illustration of such drawing. It will be seen that a feed device 11 provided with two transport rollers 11*a* serves for feeding of fiber or fibrous material to an opening roller 12 having an outer surface or roller envelope 12*a*. The opening roller 12 is provided with suitable clothing 13 which is formed of teeth 13*a*. The terms "roller envelope" or "outer surface" refer to the circumferential surface containing the points or tips 13*b* of the teeth 13*a*. The opening roller 12 is rotatable about its axis of rotation 15 in the rotational sense or direction indicated by the arrow 14. A pivotable frame 16 carries bars 17 which form a grating 17*a*. A pivotable element or flap 18 extends over a part of the roller envelope or outer surface 12*a*. This roller envelope part together with the pivotable element or flap 18 defines a suction chamber 22.

A screening member 19 has a screening wall 20 which also extends over part of the roller envelope or outer surface 12*a*. The screening member 19 has a nose or nose member 21 at its forward end considered with reference to the aforementioned direction of rotation of the opening roller 12 indicated by the arrow 14. A suction duct 23 extends away from this nose 21 and flow communicates with the suction chamber 22. The entry opening 23*a* of the suction duct 23 is located at the region of the nose or nose member 21. The parts 11, 17, 18 and 19, which are arranged around the opening roller 12, extend over the complete length of such opening roller 12 in the direction of the rotational axis 15. The hollow spaces between the outer surface or roller envelope 12*a* and the pivotable element or flap 18 and screening wall 20 are closed at both ends.

During operation of the illustrated cleaning machine the fiber or fibrous material which is to be cleaned is fed to the clothing 13 by means of the transport rollers 11*a*. Thus, when the opening roller 12 is rotating, such fiber material is taken up by the teeth 13*a*, i.e., by the clothing 13. Due to the centrifugal forces caused by the rotation of the opening roller 12, impurities such as seeds, dust particles and the like present in the fiber material are hurled outwardly and, with the co-operation of the grating bars 17, are separated from the fibers which during this stage of the cleaning operation are retained on the teeth 13*a* of the clothing 13. Thereafter, the fiber material separates from the clothing 13 into the suction chamber 22 as a result of the effect produced by the suction chamber 22, the suction duct 23 and the screening wall 20. The cleaned fibers carried away by the suction duct 23 thereafter pass to a suitable location for further processing.

Experience has shown that the separation of the fibers from the clothing 13 is substantially improved in comparison to the currently known machines if the screening wall 20 has a form or structure according to which the mutual spacing between the screening wall 20 and the clothing 13 increases in the direction away from the nose or nose member 21 in the sense of the opening roller rotation indicated by the arrow 14. This means that in comparison with the current state of the art, a trouble-free separation of the fiber flocks is obtained with a reduced quantity of air flowing through the suction duct 23, thus resulting in a saving of energy. The screening wall 20 seems to operate as a sealing element by means of which damming-up of air is produced between the boundaries 12*a* and 20 defined by the outer surface 12*a* of the opening roller 12 and the screening wall 20. Vortices arise between these boundaries 12*a* and 20 by means of which a back flow of air can occur at the nose or nose member 21 in a direction opposite to the direction of rotation 14 of the opening roller 12.

An additional, substantial saving of suction air is obtained with an embodiment of the invention in which a closure wall 24 is provided at the rear end 20*a* of the screening wall 20 considered with reference to the direction of opening roller rotation indicated by the arrow 14. This closure wall 24 extends from the end of the screening wall 20 to a location close to the roller envelope or outer surface 12*a*. As compared to an arrangement without a closure wall this embodiment produces a trouble-free separation of the fibers from the clothing 13 with a still further reduced quantity of air in the suction duct 23, and there is also avoided contamination of the nose or nose member 21.

A further advantageous embodiment of the invention (in order to produce a diversion of the material flow which is as favorable and loss-free as possible) is obtained by the provision of a pivotable element or flap 18 which is formed as shown in the drawing. The flap or pivotable element 18 extends from the entry or inlet opening 23*a* of the suction duct 23 located at the region of the nose 21 opposite to the direction of rotation 14 of the opening roller 12 over a portion of the roller envelope or outer surface 12*a*, the mutual spacing of the latter and the pivotable element or flap 18 reducing from the entry opening 23*a* of the suction duct 23 towards the end 18*a* of the flap or pivotable element 18 spaced furthest from this entry opening 23*a*. At the end 18*a* the flap or pivotable element 18 forms a gap or opening 25 with the flap or roller envelope or outer surface 12*a*. The part of the pivotable element 18 defining the gap or opening 25 is arranged as close as possible to the roller envelope or outer surface 12*a*.

This type of air entry also has an essential influence on the separation of the fiber material from the clothing 13 of the opening roller 12, since by virtue of this arrangement, on the one hand, the formed air ring around the opening roller 12 is disturbed and, on the other hand, only a portion of the necessary quantity of suction air is drawn or taken-in directly from outside the cleaning machine. The remainder of the necessary quantity of suction air is obtained from the skimmed-off air ring.

Furthermore, a gap or opening 26 is present between the roller envelope or outer surface 12*a* and the nose or nose member 21, and furthermore a gap or opening 27 is formed between the roller envelope or outer surface 12*a* and the closure wall 24.

It is important to maintain the width of the gap or opening 26 small. It has been found that the mentioned air ring forms about the rapidly rotating opening roll 12. This air ring opposes the centrifugal force of the fiber material clinging to the saw-toothed clothing 13. On the other hand, the narrow gap or opening 26 between the nose 21 and the roller envelope or outer surface 12*a* destroys this air ring. It is "skimmed-off" by such narrow gap or opening 26. Thus, the provision of a narrow gap or opening 26 produces easy separation of the fiber flocks or the like from the clothing 13.

As previously mentioned, the clothing 13 consists of a plurality of teeth 13*a*. The above-mentioned air ring can be considered to be made-up of an inner sub-ring and an outer sub-ring. The inner sub-ring comprises the air located between the teeth 13*a*, and thus, has a thickness which is essentially equal to the height of these teeth 13*a*. Its maximum diameter is equal to that of the roller envelope or outer surface 12*a*. The outer sub-ring is located beyond the inner sub-ring and its smallest diameter is equal to that of the roller envelope or outer surface 12*a*. The inner sub-ring of the bipartite air ring is removed from the immediate influence of the nose or nose member 21 since the latter cannot project into this inner sub-ring. However, such projection of the nose member 21 occurs in the case of the outer sub-ring, so that the latter can be influenced immediately by this nose member 21. Influence upon the complete air ring is thus greater the larger the part of the air ring which is under the immediate influence of the nose or nose member 21, that is the thicker the outer air ring in relation to the inner air ring. In correspondence with these observations, a tooth height up to approximately 5 mm proves to be especially advantageous with the present invention, because under these conditions considerable weakening of the air ring is possible.

For the purpose of indication of further approximate dimensions it is here mentioned that with a tooth height of approximately 5 mm, there are advantageously obtained low values of the required quantity of suction air through the suction duct 23 with a mutual spacing of the screening wall 20 and roller envelope or outer surface 12*a* of approximately 2 mm at the nose 21 and of approximately 10 mm at the rear end 20*a* of the screening wall 20. When a closure wall 24 is provided an advantageous value for the width of the gap or opening 26 between the roller envelope or outer surface 12*a* and the nose or nose member 21 is approximately 2 mm and an advantageous value for the width of the gap or opening 27 between the roller envelope or outer surface 12*a* and the edge of the closure wall 24 adjacent the roller envelope or outer surface 12*a* is also approximately 2 mm.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A cleaning machine for fiber material comprising:

an opening roller rotatable about an axis of rotation thereof and having a roller envelope;

clothing having points and provided for said opening roller;

said roller envelope containing the points of the clothing;

a feed device for infeeding of the fiber material to the opening roller;

a grating formed of bars cooperating with the opening roller;

a suction chamber cooperating with the opening roller;

a screening member cooperating with the opening roller;

said feed device, said grating, said suction chamber and said screening member being successively arranged around said opening roller and extending substantially over the length of the opening roller in the direction of the axis of rotation of said opening roller;

a nose member provided for said screening member;

a suction duct leading away from the suction chamber and in flow communication therewith;

said suction duct having an entry opening;

said nose member forming part of said entry opening of said suction duct;

said screening member having a screening wall extending away from the nose member in the direction of rotation of the opening roller over a part of said roller envelope containing the points of the clothing;

said screening wall having a rear end; and the screening wall and roller envelope possessing a mutual spacing from one another which increases in the direction of rotation of the opening roller from the nose member to the rear end of the screening wall.

2. The cleaning machine as defined in claim 1, further including:

a closure wall extending from said rear end of the screening wall to a location immediately adjacent the roller envelope.

3. The cleaning machine as defined in claim 2, wherein:

the closure wall extends substantially radially with respect to the opening roller.

4. The cleaning machine as defined in claim 1, further including:

a flap extending from the entry opening of the suction duct opposite to the direction of rotation of the opening roller over a part of the roller envelope and defining with the latter the suction chamber;

said flap and roller envelope having a mutual spacing with respect to one another which decreases in a direction away from the entry opening of the suction duct; and an end of the flap which is spaced remote from the entry opening being separated from the roller envelope by a gap.

5. The cleaning machine as defined in claim 1, wherein:

said clothing contains teeth defining said points; and the teeth of the clothing possessing a height which does not exceed approximately 5 mm.

6. The cleaning machine as defined in claim 5, wherein:

the mutual spacing of the screening wall and roller envelope increases from approximately 2 mm at the nose member to approximately 10 mm at the rear end of the screening wall.

7. The cleaning machine as defined in claim 5, further including:

a closure wall extending from the rear end of the screening wall to a location immediately adjacent the roller envelope; and a gap formed between the nose member and the roller envelope and a gap formed between the closure member and the roller envelope each having a width of approximately 2 mm.

8. A cleaning machine for fiber material comprising:

an opening roller rotatable about an axis of rotation thereof and having a roller envelope;

clothing having points and provided for said opening roller;

said roller envelope containing the points of the clothing;

a feed device for infeeding of the fiber material to the opening roller;

a grating formed of bars cooperating with the opening roller;

a suction chamber cooperating with the opening roller;

a screening member cooperating with the opening roller;

said feed device, said grating, said suction chamber and said screening member being successively arranged around said opening roller and extending substantially over the length of the opening roller in the direction of the axis of rotation of said opening roller;

a nose member provided for said screening member;

a suction duct leading away from the suction chamber and in flow communication therewith;

said suction duct having an entry opening;

said nose member forming part of said entry opening of said suction duct;

said screening member having a screening wall extending away from the nose member in the direction of rotation of the opening roller over a part of said roller envelope containing the points of the clothing;

said screening wall having a rear end;

the screening wall and roller envelope possessing a mutual spacing from one another which increases in the direction of rotation from the nose member to the rear end of the screening wall; and a closure wall extending from said rear end of the screening wall to a location immediately adjacent the roller envelope.

* * * * *

UNITED STATES PATENT AND TRADEMARK OFFICE

CERTIFICATE OF CORRECTION

PATENT NO. : 4,507,827

DATED : April 2, 1985

INVENTOR(S) : URS STAEHLI

It is certified that error appears in the above—identified patent and that said Letters Patent is hereby corrected as shown below:

Column 3, line 58, after "the" please delete "flap or"

Column 3, line 59, after "the" (second occurrence) and before "pivotable" please insert --flap or--

Signed and Sealed this

*Twenty-seventh* Day of *August 1985*

[SEAL]

*Attest:*

DONALD J. QUIGG

*Attesting Officer* *Acting Commissioner of Patents and Trademarks*